US005544877A

United States Patent [19]

Brownell

[11] Patent Number: 5,544,877

[45] Date of Patent: Aug. 13, 1996

[54] BASKETBALL SHOOTING TRAINING AID

[76] Inventor: Neal G. Brownell, P.O. Box 420, Wassaic, N.Y. 12592

[21] Appl. No.: 463,977

[22] Filed: Jun. 5, 1995

[51] Int. Cl.[6] ..... A63B 69/00

[52] U.S. Cl. ..... 273/1.5 A; 602/20

[58] Field of Search ..... 273/1.5 A, 189 R, 273/189 A, 188 R; 473/63; 602/20, 23, 26

[56] References Cited

U.S. PATENT DOCUMENTS

| | | | |
|---|---|---|---|
| 698,831 | 12/1901 | Pettee | 602/26 |
| 3,698,389 | 10/1972 | Guedel | 273/189 A X |
| 4,014,327 | 3/1977 | Spiro | 273/189 A X |
| 4,188,944 | 2/1980 | Augustyniak | 602/20 |
| 5,222,733 | 6/1993 | Brunty | 273/188 R X |

FOREIGN PATENT DOCUMENTS

| | | | |
|---|---|---|---|
| 988284 | 1/1983 | U.S.S.R. | 602/20 |

OTHER PUBLICATIONS

KBA Basketball Coaching And Training Aids 1989 School Mail Order Catalog, 12–1988, P. 1 "The Shooter".

*Primary Examiner*—Paul E. Shapiro

[57] ABSTRACT

A basketball shooting training aid with braces attached to the upper arm and forearm of a user and an interconnecting adjustable control strap. The control strap is adjusted by a user to restrict the angle to which the elbow can be bent on the backward movement of the arm to about 90 degrees. Forward movement of the arm during a shot is not restricted.

4 Claims, 2 Drawing Sheets

BASKETBALL SHOOTING TRAINING AID

FIELD OF THE INVENTION

This invention relates to basketball shooting training aids, and in particular to an aid that teaches the user the proper amount of bend of the arm at the elbow in preparing to shoot the basketball.

BACKGROUND OF THE INVENTION

Coaching of basketball players includes teaching of skills that will produce proper movement of many parts of the body to enhance the accuracy of shots directed to the basket. Included in these skills is the proper positioning and control of the shooting arm of the player.

Several training aids for teaching the proper motion of the shooting arm of the player are represented by U.S. Pat. Nos. 3,820,783 to Caveness, 4,383,685 to Bishop, and 4,579,341 to Furr. All of these patents teach an apparatus that includes a harness arrangement that must be accurately fitted and applied to the torso of the user. Complicated and cumbersome hardware is included with the harness to guide the shooting arm. All of these aids appear to require assistance from another person to properly attach the apparatus to the user. These patents also only address an aid for the purpose of controlling the positioning and movement of the elbow of the user ignoring control of the positioning of the arm itself. Another U.S. Pat. No. 5,135,217 to Swain only deals with an apparatus worn by the user that controls the action of the wrist of the user during a shot.

It is known that proper motion of the shooting arm of a player, whether executing a set shot or a jump shot, should not be allowed to bend more than 90 degrees prior to shooting towards the basket.

SUMMARY OF THE INVENTION

The objects and features of the present invention are to provide a basketball shooting training aid that:

Controls the relative position between the upper arm and forearm of the shooting arm of a user;

Restricts the bending of the elbow of the shooting arm to an angle of 90 degrees between the upper arm and the forearm; and Is of simple construction and can be applied to the shooting arm by the user without assistance.

These and other objects, features and advantages are achieved in a basketball shooting training aid that includes an adjustable control strap connected to apparatus on the upper arm and forearm of a user. The control strap is positioned in contact with the outside of the elbow of the shooting arm. The control strap may be adjusted in length and fixed while the arm of the user is bent at a 90 degree angle. The strap is unyielding so that in use the arm cannot be bent to more than a 90 degree angle between the upper arm and forearm of the user. Although the strap restricts the amount of bend in preparation for shooting, forward movement during the shot is not restricted.

DETAILED DESCRIPTION OF THE PRESENT INVENTION

Figure 1:
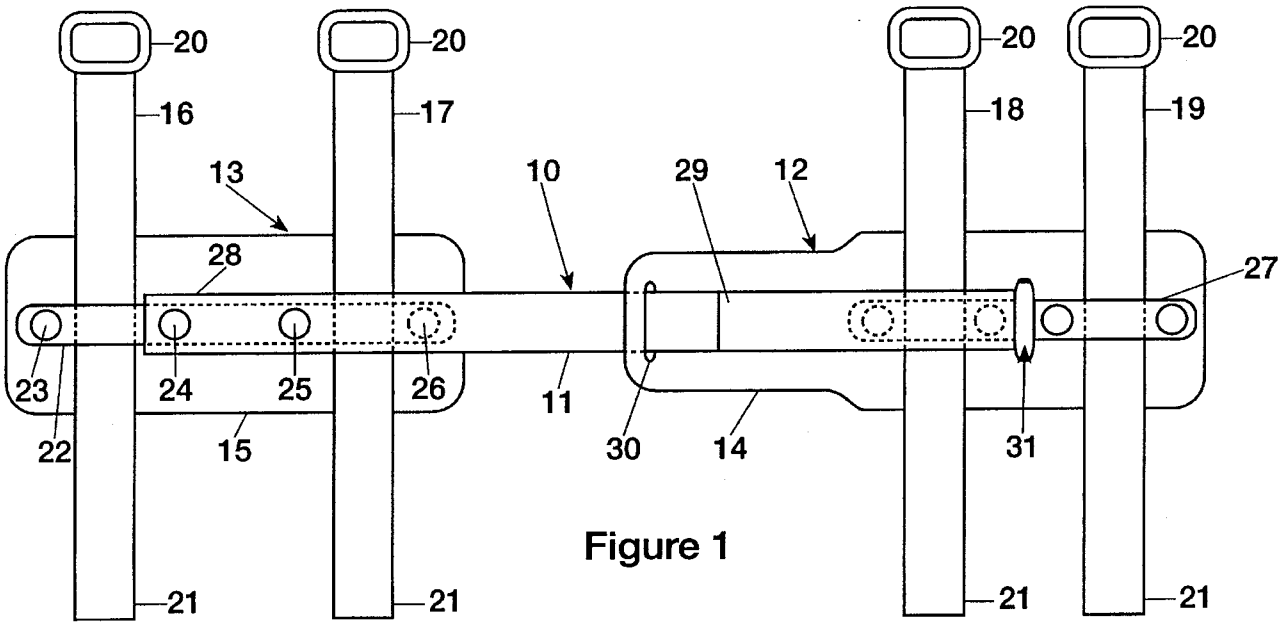
FIG. 1 is a plan view of the training aid of the present invention.
Figure 2:
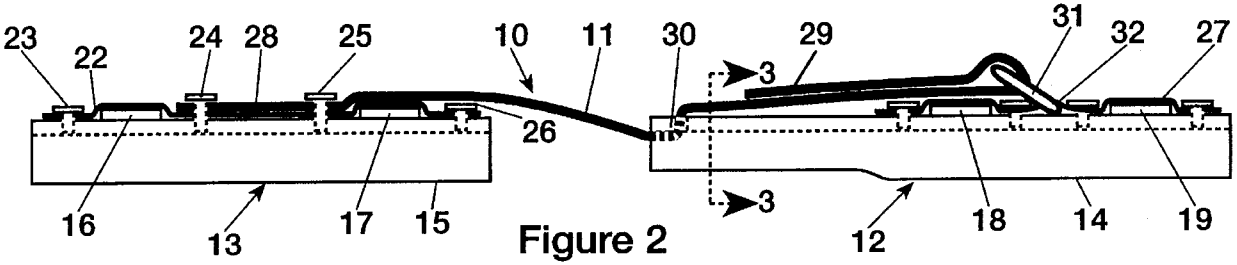
FIG. 2 is a side elevation view of the training aid of the present invention.
Figure 3:
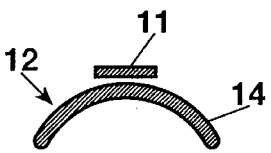
FIG. 3 is a cross section of the upper arm portion of the training aid of the present invention shown in FIG. 2.

With reference to FIGS. 1, 2 and 3, the basketball shooting training aid of the present invention is noted generally at 10. Its basic components include a control strap 11 interconnecting an upper arm connector noted generally at 12 and a forearm connector noted generally at 13. The upper arm connector 12 is comprised of a brace 14 and the forearm connector 13 is comprised of a brace 15. Both the brace 14 and brace 15 is constructed from a rigid plastic material that has a length and width, and is curved as shown in FIG. 3, that accommodates a portion of the upper arm and forearm of a user.

The braces 14 and 15 are each attached to the upper arm and forearm of a user by straps 16, 17, 18 and 19. Each of the straps 16 through 19 includes an attached D-ring 20 and is made from self-adhering material that allows the ends 21 to be passed through the D-rings 20 to attach the braces 14 and 15 to the upper arm and forearm respectively of a user.

Straps 16 and 17 are attached to the brace 15 by a metal or plastic strap 22 which is attached to the brace 15 by rivets 23, 24, 25 and 26. As best shown in FIG. 2 the metal strap 22 is raised to retain straps 16 and 17 and allow for the straps 16 and 17 to be moved to position D-rings 20 in the center of a user's forearm.

In a like manner, straps 18 and 19 are attached to the upper arm brace 14 by a metal or plastic strap 27 riveted to the brace 14. Strap 27 is also raised to retain straps 18 and 19 for adjustment.

The control strap 11 is comprised of a first end 28 and a second end 29. It is comprised of a flexible but longitudinally unyielding, self adhering material. The first end 28 of the control strap 11 is attached to the forearm brace 15 by rivets 24 and 25. The second end 29 of control strap 11 passes through a control strap guide comprised of a slot 30 in the upper arm brace 14. As shown best in FIG. 2, the second end 29 of control strap 11 passes through the slot 30 and is received through a D-ring 31. D-ring 31 is attached to the brace 14 at a raised portion 32 in the strap 27. The length of the control strap 11 between the first end 28 and the D-ring 31 can be adjusted and fixed by adhering the second end 29 to the control strap 11. Best shown in FIG. 1 is the narrowing of the width of upper arm brace 14 for a portion of the length near the slot 30 to accommodate the narrowing of the upper arm at the elbow.

Figure 4:
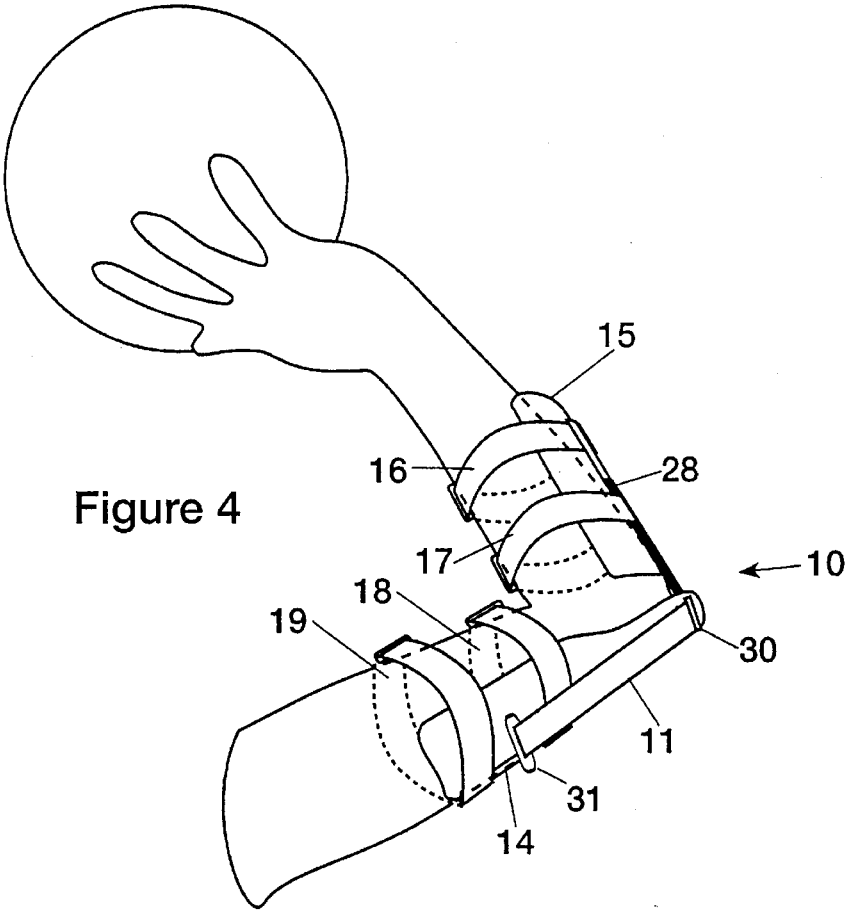
FIG. 4 is a representation of the use of the training aid of the present invention that restricts the movement of the arm of a user prior to shooting a basketball.
Figure 5:
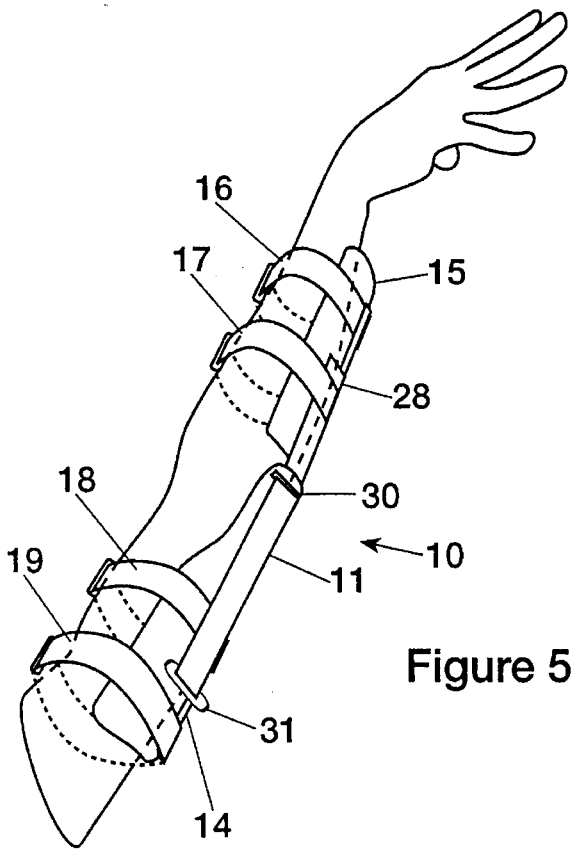
FIG. 5 is a representation of the use of the training aid of the present invention after shooting a basketball.

FIG. 4 and FIG. 5 show the basketball shooting training aid 10 in use. The aid 10 is applied to the shooting arm of the user by initially forming loops of the straps 16 through 19 by passing the ends 21 through the D-rings 20, turning the strap back on itself, and then adhering the ends 21 to the straps. The loops should be large enough to allow the hand and arm to pass through the loops. The elbow should be near the slot 30 of the upper arm brace 14 and the forearm brace 15 should be at least two inches from the elbow. The control strap 11 may have to be loosened to allow for the proper positioning. Straps 16 through 19 can then be tightened to provide a snug fit of braces 14 and 15 to the upper arm and forearm respectively. When properly applied, the forearm brace 15 should face the basket while shooting, and the control strap 11 will pass over the outside of the elbow.

The purpose of the aid 10 is to restrict the angle to which the shooting arm of the user can be bent. When the braces 14 and 15 have been properly applied to the arm, the arm should be bent to a 90 degree angle. Then the length of the control strap 11 between the first end 28 on brace 15 and the D-ring 31 on brace 14 is fixed by applying the second end 29 to the self-adhering material of the control strap 11 as best shown in FIG. 2. Although bending of the arm is restricted in preparation for a shot, forward movement during the shot is not restricted.

While I have illustrated and described the preferred embodiment of the invention, it is to be understood that I do not limit myself to the precise construction herein disclosed, and the right is reserved to all changes and modifications coming within the scope of the invention as defined in the appended claims.

Having thus described my invention, what I claim as new, and desire to secure by Letters Patent is:

1. A basketball shooting training aid comprising:

a forearm brace;

an upper arm brace;

said forearm brace and said upper arm brace having a length and width and form to accommodate a portion of the forearm and upper arm respectively of the user, and freely moveable adjustable strap means connected to said braces for attaching said braces to the arm of a user on the part of the arm adjacent to the outside of the elbow;

a flexible but longitudinally un-yielding control strap interconnecting said forearm brace and said upper arm brace; and adjusting means associated with said control strap, said forearm brace and said upper arm brace for restricting the angle to which the forearm and upper arm can be bent at the elbow on backward movement of the arm of a user.

2. A basketball shooting training aid in accordance with claim 1 wherein:

said upper arm brace includes a control strap guide adjacent to the elbow of a user for positioning said control strap over the elbow of a user.

3. A basketball shooting training aid in accordance with claim 2 wherein:

said control strap includes a first and a second end;

said adjusting means includes, means for attaching said first end of said control strap to the outside of said forearm brace, and receiving means attached to the outside of said upper arm brace adapted to receive said second end of said control strap for controlling the length of said control strap between said receiving means and said first end of said control strap.

4. A basketball shooting training aid in accordance with claim 3 wherein:

the width of said upper arm brace is narrowed for a portion of its length near said control strap guide.

* * * * *